US007495626B2

(12) United States Patent
Hart et al.

(10) Patent No.: US 7,495,626 B2
(45) Date of Patent: Feb. 24, 2009

(54) ANTENNA FOR ELECTRON SPIN RADIATION

(75) Inventors: Robert T. Hart, Eatonton, GA (US); Vladimir I. Korbejnikov, Saint-Petersbur (RU)

(73) Assignee: HZ Antenna, LLC, Eatonton, GA (US)

( * ) Notice: Subject to any disclaimer, the term of this patent is extended or adjusted under 35 U.S.C. 154(b) by 625 days.

(21) Appl. No.: 11/179,264

(22) Filed: Jul. 12, 2005

(65) Prior Publication Data

US 2007/0013595 A1 Jan. 18, 2007

(51) Int. Cl.
*H01Q 7/08* (2006.01)

(52) U.S. Cl. ..... 343/788; 343/742; 343/895

(58) Field of Classification Search ..... 343/788, 343/742, 866, 895

See application file for complete search history.

(56) References Cited

U.S. PATENT DOCUMENTS

2002/0003503 A1* 1/2002 Justice ..... 343/788

* cited by examiner

*Primary Examiner*—Trinh V Dinh
*Assistant Examiner*—Dieu Hien T Duong
(74) *Attorney, Agent, or Firm*—Bryan W. Bockhop; Bockhop & Associates, LLC

(57) ABSTRACT

An antenna for generating electron spin radiation corresponding to a signal from a radio frequency communications device includes a substantially cylindrical conductor, a first spiral-wound flat inductor, a second spiral-wound flat inductor and a reactive element. The first spiral-wound flat inductor is wound in relation to the second spiral-wound flat inductor so that when a current flows from the first signal terminal to the second signal terminal, a first magnetic field is generated from the first spiral-wound flat inductor and a second magnetic field is generated from the second spiral-wound flat inductor. The first magnetic field is in an opposite direction from the second magnetic field. The substantially cylindrical conductor is disposed so as to intersect the first magnetic field and the second magnetic field. The antenna may also be used to receive electron spin radiation.

10 Claims, 3 Drawing Sheets

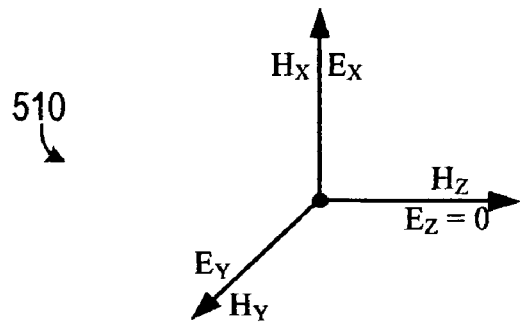

FIG. 5A

520

$$\dot{H}_x = \frac{\gamma' m\pi}{\lambda_x\left[\omega^2 \mu\mu_0 \varepsilon\varepsilon_0 + (\gamma')^2\right]} \dot{H}_0 \sin\left(\frac{m\pi x}{\lambda_x}\right) \cos\left(\frac{n\pi y}{\lambda_y}\right) \exp\left(i\cdot\omega t - \gamma' z\right) ;$$

$$\dot{H}_y = \frac{\gamma' n\pi}{\lambda_y\left[\omega^2 \mu\mu_0 \varepsilon\varepsilon_0 + (\gamma')^2\right]} \dot{H}_0 \cos\left(\frac{m\pi x}{\lambda_x}\right) \sin\left(\frac{n\pi y}{\lambda_y}\right) \exp\left(i\cdot\omega t - \gamma' z\right) ;$$

$$\dot{H}_z = \dot{H}_0 \cos\left(\frac{m\pi x}{\lambda_x}\right) \cos\left(\frac{n\pi y}{\lambda_y}\right) \exp\left(i\cdot\omega t - \gamma' z\right) ;$$

$$\dot{E}_x = \frac{i\cdot\omega\mu\mu_0 m\pi}{\lambda_y\left[\omega^2 \mu\mu_0 \varepsilon\varepsilon_0 + (\gamma')^2\right]} \dot{H}_0 \cos\left(\frac{m\pi x}{\lambda_x}\right) \sin\left(\frac{n\pi y}{\lambda_y}\right) \exp\left(i\cdot\omega t - \gamma' z\right) ;$$

$$\dot{E}_y = -\frac{i\cdot\omega\mu\mu_0 m\pi}{\lambda_x\left[\omega^2 \mu\mu_0 \varepsilon\varepsilon_0 + (\gamma')^2\right]} \dot{H}_0 \sin\left(\frac{m\pi x}{\lambda_x}\right) \cos\left(\frac{n\pi y}{\lambda_y}\right) \exp\left(i\cdot\omega t - \gamma' z\right) ;$$

$$\dot{E}_z = 0$$

FIG. 5B

ANTENNA FOR ELECTRON SPIN RADIATION

BACKGROUND OF THE INVENTION

1. Field of the Invention

The present invention relates to radio frequency communications and, more specifically, to an antenna system employed in radio frequency communications.

2. Description of the Prior Art

Radio signals usually start with electrical signals that have been modulated onto a radio frequency carrier wave. The resulting radio signal is transmitted using an antenna. The antenna is a system that generates an electrical field (E field) and a magnetic field (H field) that vary in correspondence with the radio signal, thereby forming radio frequency radiation. At a distance from the antenna, as a result of transmission effects of the medium through which the radio frequency radiation is being transmitted, the E field and the H field fall into phase with each other, thereby generating a Poynting vector, which is given by $S=E\times H$, where S is the Poynting vector, E is the E field vector and H is the H field vector.

Conventional Hertz antenna systems are resonant systems that take the form of wire dipoles or ground plane antennas that run electrically in parallel to the output circuitry of radio frequency transmitters and receivers. Such antenna systems require, for maximum performance, that the length of each wire of the dipole, or the radiator or the ground plane be one fourth of the wavelength of the radiation being transmitted or received. For example, if the wavelength of the radiation is 1000 ft., the length of the wire must be 250 ft. Thus, the typical wire antenna requires a substantial amount of space as a function of the wavelength being transmitted and received A form of radiation, referred to as "Kor radiation," has recently been discovered. Kor radiation corresponds to a radio frequency signal having a voltage and current at a radio frequency. This type of radiation exists as a result of electron spin and is based on radiation along an $H_z$ vector in a three dimensional model of Maxwell's equations. This vector is not accompanied with an $E_z$ vector, thus the radiation is a form of magnetic radiation. Kor radiation is the result of the electric charge in electrons in motion. Moving electron charge always has two components: forward velocity and electron spin. As a result, the electromagnetic field of a dynamic charge consists of two complex components: two (2) separate and distinct electromagnetic fields. The properties of these two electromagnetic fields are very different in space. Therefore, there is conventional electromagnetic radiation and the Kor radiation resulting from antennas that are capable of causing electrons to spin.

Kor radiation has the ability to penetrate certain substances with greater ease that conventional electromagnetic radiation. However, there is no currently-available practical antenna that is capable of receiving or transmitting Kor radiation. Therefore, there is a need for an antenna that facilitates communications using Kor radiation.

SUMMARY OF THE INVENTION

The disadvantages of the prior art are overcome by the present invention which, in one aspect is an antenna for generating radiation corresponding to a signal from a radio frequency communications device having a first signal terminal and a second signal terminal. The antenna includes a substantially cylindrical conductor, a first spiral-wound flat inductor, a second spiral-wound flat inductor and a reactive element. The first spiral-wound flat inductor has a first interior end and a first exterior end. The first exterior end is electrically coupled to the first signal terminal of the radio frequency communications device and is substantially coaxial with the cylindrical conductor. The second spiral wound flat inductor has a second interior end and a second exterior end. The second spiral-wound flat inductor is spaced apart from the first spiral-wound flat inductor and is substantially coaxial therewith. The first interior end is electrically coupled to the second interior end. The second exterior end is electrically coupled to the second signal terminal of the radio frequency communications device. The second spiral-wound flat inductor is substantially coaxial with the cylindrical conductor. The reactive element is electrically coupled at least to one of the first exterior end and the second exterior end. The first spiral-wound flat inductor is wound in relation to the second spiral-wound flat inductor so that when a current flows from the first signal terminal to the second signal terminal, a first magnetic field is generated from the first spiral-wound flat inductor and a second magnetic field is generated from the second spiral-wound flat inductor. The first magnetic field is in an opposite direction from the second magnetic field. The substantially cylindrical conductor is disposed so as to intersect the first magnetic field and the second magnetic field.

In another aspect, the invention is an antenna for transmitting and receiving radiation, in association with a radio frequency signal source having a first terminal and a second terminal. The antenna includes a first radiative component, a second radiative component, a conductive component and a reactive element. The first radiative component is electrically coupled to the first terminal and is capable of generating a first magnetic field, having a first direction, in response to a signal from the radio frequency signal source. The second radiative component is electrically coupled to the second terminal and to the first radiative component and is capable of generating a second magnetic field, having a second direction, in response to a signal from the radio frequency signal source. The second direction is opposite the first direction. The conductive component is substantially coaxial with the first radiative component and the second radiative component. The conductive component is disposed so as to intersect both the first magnetic field and the second magnetic field. The reactive element is electrically coupled at least to one of the first radiative component and the second radiative component so as to cause the antenna to be resonant.

In yet another aspect, the invention is a method of generating a Kor radiative signal corresponding to an electrical signal A first magnetic field is generated in a first direction from the electrical signal A second magnetic field is generated from the electrical signal in a second direction opposite the first direction. A conductor is placed in the first magnetic field and the second magnetic field in a position such that current flowing on the conductor causes the antenna to emit Kor radiation corresponding to the electrical signal.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

BRIEF DESCRIPTION OF THE FIGURES OF THE DRAWINGS

FIG. 5A is vector diagram.

FIG. 5B is a series of Maxwell's equations relating to the vector diagram shown in FIG. 5A.

DETAILED DESCRIPTION OF THE INVENTION

Figure 1A:
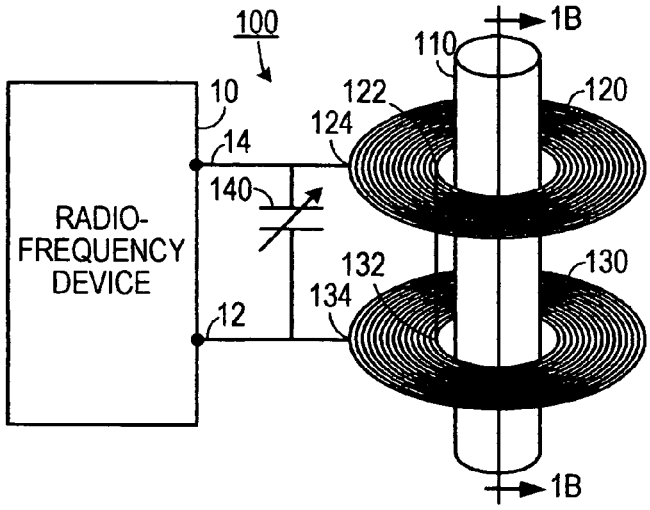
FIG. 1A is a top perspective view of a first illustrative embodiment of the invention.

A preferred embodiment of the invention is now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on."

Figure 1B:
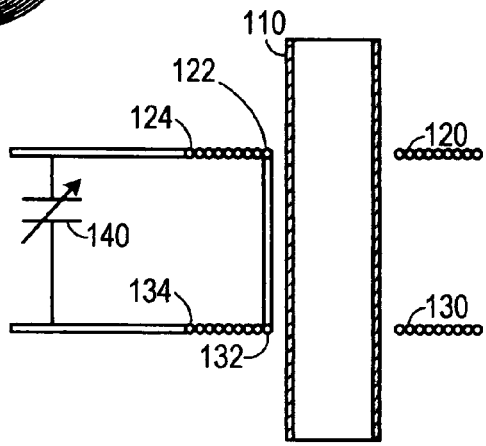
FIG. 1B is a cross-sectional view of the embodiment shown in FIG. 1A, taken along line 1B-1B.

As shown in FIGS. 1A and 1B, one illustrative embodiment of the invention is an antenna 100 for generating radiation corresponding to a signal from a radio frequency communications device 10, such as a transmitter or a receiver, having a first signal terminal 12 and a second signal terminal 14. The antenna 10 includes a substantially cylindrical conductor 110, a first spiral-wound flat inductor 120 and a second spiral-wound flat inductor 130, both of which are substantially coaxial with the cylindrical conductor. The first spiral-wound flat inductor 120 has a first interior end 122 and a first exterior end 124. The first exterior end 124 is electrically coupled to the first signal terminal 12 of the radio frequency communications device 10.

The second spiral-wound flat inductor 130, which is substantially coaxial with the cylindrical conductor 110, has a second interior end 132 and a second exterior end 134. The second spiral-wound flat inductor 130 is spaced apart from a and is substantially coaxial with, the first spiral-wound flat inductor 120. The first interior end 122 is electrically coupled to the second interior end 132 and the second exterior end 134 is electrically coupled to the second signal terminal 14 of the radio frequency communications device 10. A reactive element 140, such as a variable capacitor, is electrically coupled to either of the first exterior end 124 or the second exterior end 134.

The first spiral-wound flat inductor 120 is wound in relation to the second spiral wound flat inductor 130 so that when a current flows from the first signal terminal to the second signal terminal, a first magnetic field is generated from the first spiral-wound flat inductor and a second magnetic field, in an opposite direction from the first magnetic field, is generated from the second spiral-wound flat inductor. This can be done by winding the first spiral-wound flat inductor 120 in a first direction and counter winding the second spiral wound flat inductor 130.

Figure 2A:
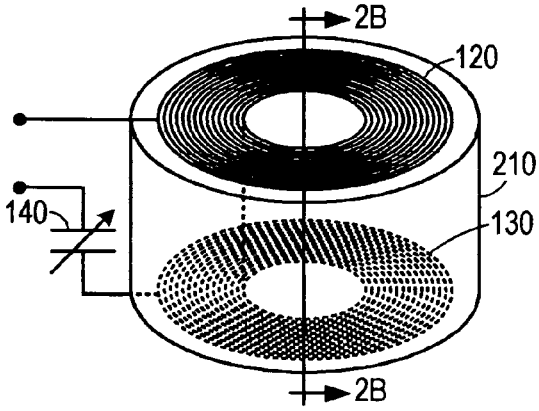
FIG. 2A is a top perspective view of a second illustrative embodiment of the invention.
Figure 2B:
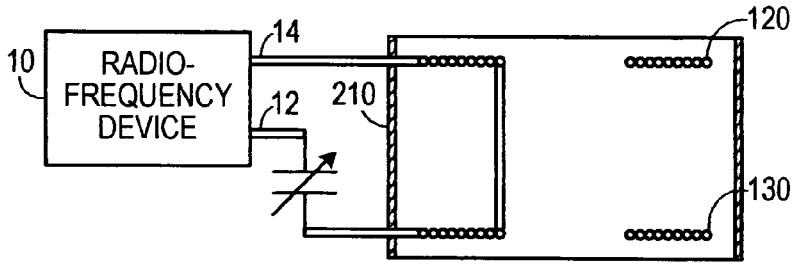
FIG. 2B is a cross-sectional view of the embodiment shown in FIG. 2A, taken along line 2B-2B.

The cylindrical conductor 110 is disposed so as to intersect the first magnetic field and the second magnetic field. The cylindrical conductor 110 could be a conductive rod or cylinder and could be disposed inside the first spiral-wound flat inductor 120 and the second spiral-wound flat inductor 130. As shown in FIGS. 2A and 2B, the cylindrical conductor 210 could be disposed around the first spiral-wound flat inductor 120 and the second spiral-wound flat inductor 130 so as to surround them.

To complete the antenna 100 it is necessary to cause maximum current to flow in the coils 120 and 130. This is made possible by canceling the inductive reactance of the coils with a reactive element 140. The reactive element 140, has a first lead 142 and a second lead 144. A parallel resonant circuit may be formed with the antenna 100 by electrically coupling the first lead 142 to the first exterior end 124 and the second lead 144 to the second exterior end 134. Similarly, a series resonant circuit may be formed with the antenna 100 by electrically coupling the first lead 142 to the first exterior end 124 and the second lead 144 to the first signal terminal 14. FIG. 2 shows the coils 120 and 130 connected in series with a series capacitor 140 to cause resonance at the desired operating frequency. This would be the preferred arrangement if the radio frequency power source is low impedance. For a high impedance source the preferred arrangement would be a parallel connection of the coils 120 and 130 with a parallel capacitor, as shown in FIG. 1, to bring the antenna 100 to resonance at the desired operating frequency. Note in both the series and parallel arrangements that the coils 120 and 130 are connected so as to provide opposing magnetic fields.

Figure 3:
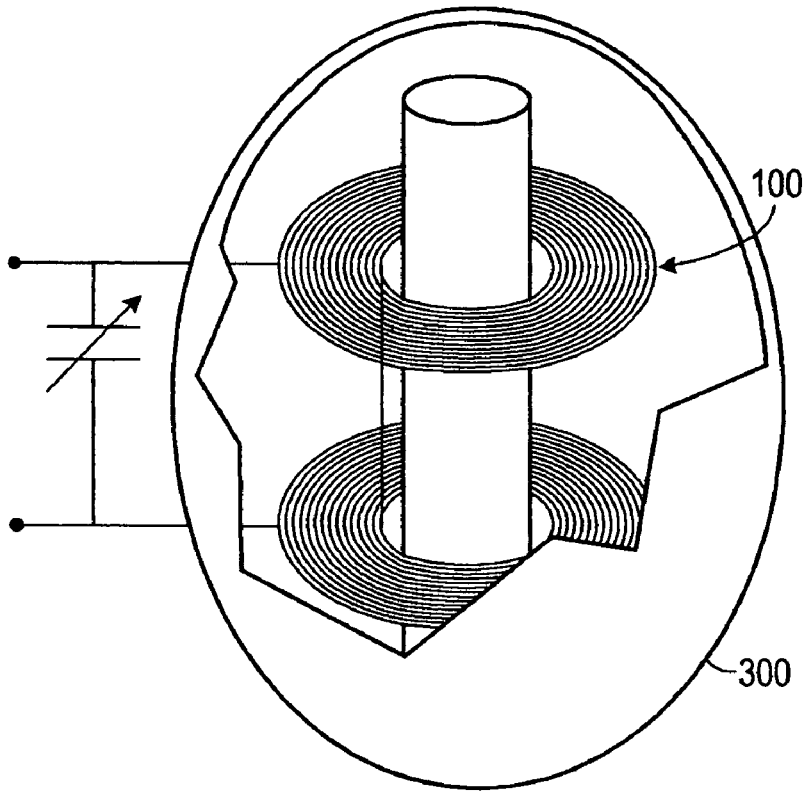
FIG. 3 is a perspective view of an embodiment that includes an exterior shielding.

As shown in FIG. 3, in one embodiment, a non-ferrous metal conductive enclosure 300 (which may be of a shape different from the shape shown) surrounds substantially the entire antenna 100. This prevents transmission of conventional radiation, while allowing Kor radiation to transmit therethrough.

Figure 4:
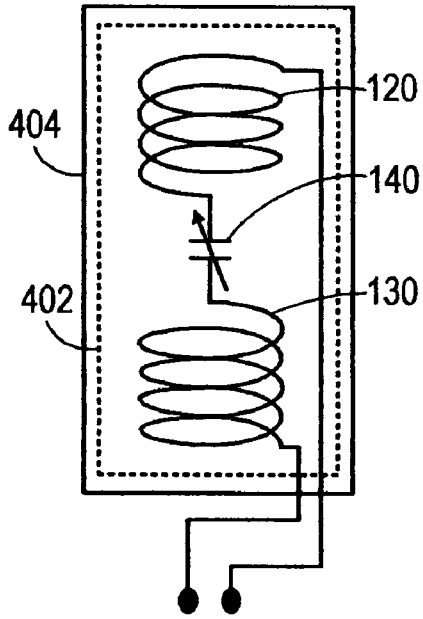
FIG. 4 is a schematic diagram of one embodiment of the invention.

As shown in FIG. 4, one embodiment has the coils 120 and 130 surrounded first by a plastic film 402 and then by a conductive foil (such as copper foil) 404. The reactive element 140 is in series with the coils 120 and 130.

In operation, the antenna 100 generates a Kor radiative signal corresponding to an electrical signal by generating from the electrical signal a first magnetic field in a first direction and generating from the electrical signal a second magnetic field in a second direction opposite the first direction. A conductor is placed in the first magnetic field and the second magnetic field in a position such that the conductor emits Kor radiation corresponding to the electrical signal. The antenna resonant frequency may be tuned to a specific frequency range by tuning the reactive element 140.

The Kor radiation corresponds to a radio frequency power signal having a voltage and current at a radio frequency. Unlike conventional antennas, this antenna 100 radiates only a reactive field, thus the antenna has no radiation resistance. Therefore, the transmitter must provide a current source or a voltage source. The antenna is inherently narrow band. The instantaneous bandwidth may be increased by adding more coils in a stagger tuned circuit.

The antenna system is comprised of two inductors 120 and 130 used to develop opposing magnetic fields, which create a current (electric charge) in a central cylinder 110 or surrounding enclosure 210. Since there are two coils in the antenna and each produces Lorenz force, under action of this pair of Lorentz's forces electric charges on the rod or enclosure rotate. The direction of the lines of the magnetic field change each half cycle. The direction of the pair of Lorentz's forces also varies in a similar manner. Rotation of electric charges on the rod or cylinder also varies on alternate half cycles.

The six (6) equations presented in FIG. 4B are a result of taking Maxwell's first two equations (defining the electric and magnetic fields) and enhancing them by applying them in three dimensions, as compared to the planer rectilinear motion of an electron used by Maxwell. Vectors, as shown in FIG. 4A, represent a physical interpretation of the components defined by the enhanced Maxwell's equations for an electromagnetic field of a dynamic charge in space. X and Y vectors represent the common standard interpretation of an electromagnetic wave in space due to the forward progress of a charge (current). The Hz vector represents a magnetic component due to rotary (spin) movement of an electric charge. The Ez vector has a value equal to 0.

The influence of changing counter magnetic streams from coils 120 and 130 on electric charges on the central element 110 is that two counter changing magnetic streams create a pair of Lorentz's forces which operate on electric charges on the central element. Lorentz's forces act on an electric charge causing it to change its direction of travel. This is sometimes referred to as electric force of an induced electric field which influences an electric charge. Under action of this pair of Lorentz's forces electric charges on the cylinder rotate. The magnetic field lines change direction each half cycle. The direction of the pair of Lorentz's forces also varies in a similar manner. Rotation of electric charges on the cylinder also varies on alternate half cycles. Rotary dynamics of electric charges of the cylinder can be compared to periodic rotation of a pendulum of a clock around an axis.

The above-described embodiments are given as illustrative examples only. It will be readily appreciated that many deviations may be made from the specific embodiments disclosed in this specification without departing from the invention. Accordingly, the scope of the invention is to be determined by the claims below rather than being limited to the specifically described embodiments above.

What is claimed is:

1. An antenna for generating radiation corresponding to a signal from a radio frequency communications device having a first signal terminal and a second signal terminal, the antenna comprising:

a. a substantially cylindrical conductor;

b. a first spiral-wound flat inductor, having a first interior end and a first exterior end, the first exterior end electrically coupled to the first signal terminal of the radio frequency communications device, the first spiral-wound flat inductor being substantially coaxial with the cylindrical conductor;

c. a second spiral-wound flat inductor, having a second interior end and a second exterior end, the second spiral-wound flat inductor being spaced apart from the first spiral-wound flat inductor and substantially coaxial therewith, the first interior end electrically coupled to the second interior end, the second exterior end electrically coupled to the second signal terminal of the radio frequency communications device, the second spiral-wound flat inductor being substantially coaxial with the cylindrical conductor; and d. a reactive element electrically coupled to one of the first exterior end and the second exterior end, the first spiral-wound flat inductor wound in relation to the second spiral-wound flat inductor so that when a current flows from the first signal terminal to the second signal terminal, a first magnetic field is generated from the first spiral-wound flat inductor and a second magnetic field is generated from the second spiral-wound flat inductor, the first magnetic field in an opposite direction from the second magnetic field, the substantially cylindrical conductor disposed so as to intersect the first magnetic field and the second magnetic field.

2. The antenna of claim 1, wherein the substantially cylindrical conductor comprise a conductive rod that is surrounded by the first spiral-wound flat inductor and the second spiral-wound flat inductor.

3. The antenna of claim 1, wherein the substantially cylindrical conductor comprise a conductive cylinder that surrounds the first spiral-wound flat inductor and the second spiral-wound flat inductor.

4. The antenna of claim 1, wherein the reactive element comprises a capacitor, having a first lead and a second lead.

5. The antenna of claim 4, wherein the capacitor comprises a variable capacitor.

6. The antenna of claim 4, wherein the first lead of the capacitor is electrically coupled to the first exterior end and wherein the second lead of the capacitor is electrically coupled to the second exterior end, so as to form a parallel resonant circuit with the antenna.

7. The antenna of claim 4, wherein the first lead of the capacitor is electrically coupled to the first exterior end and the second lead of the capacitor is electrically coupled to the first signal terminal, so as to form a series resonant circuit with the antenna.

8. The antenna of claim 1, wherein the radio frequency communications device comprises a transmitter.

9. The antenna of claim 1, wherein the radio frequency communications device comprises a receiver.

10. The antenna of claim 1, farther comprising a non-ferrous metal enclosure that surrounds substantially all of the antenna.

* * * * *